US011136516B2

(12) United States Patent
Abdallah et al.

(10) Patent No.: US 11,136,516 B2
(45) **Date of Patent: *Oct. 5, 2021**

(54) MOTOR GASOLINE WITH IMPROVED OCTANE AND METHOD OF USE

(71) Applicant: ExxonMobil Research and Engineering Company, Annandale, NJ (US)

(72) Inventors: David J. Abdallah, Moorestown, NJ (US); Krystal B. Wrigley, Turnersville, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/869,849

(22) Filed: May 8, 2020

(65) Prior Publication Data

US 2020/0270538 A1 Aug. 27, 2020

Related U.S. Application Data

(63) Continuation-in-part of application No. 16/694,044, filed on Nov. 25, 2019, now Pat. No. 10,808,194.
(Continued)

(51) Int. Cl.
*C10L 1/232* (2006.01)
*C10L 10/10* (2006.01)

(52) U.S. Cl.
CPC ..... *C10L 1/232* (2013.01); *C10L 10/10* (2013.01); *C10L 2200/0423* (2013.01); *C10L 2270/023* (2013.01)

(58) Field of Classification Search
CPC ..... C10L 10/10; C10L 1/223; C10L 1/232; C10L 2200/0407; C10L 2200/0423;
(Continued)

(56) References Cited

U.S. PATENT DOCUMENTS 2,881,061 A * 4/1959 Brennan ..... C10L 1/232 44/333
3,639,110 A * 2/1972 Larsen ..... C10L 1/2658 44/379

(Continued)

FOREIGN PATENT DOCUMENTS

EP 1321504 A2 6/2003
WO 202011522 A1 6/2020

OTHER PUBLICATIONS

P.I. Lacey et al., A Laboratory-Scale Test to Predict Intake Valve Deposits, SAE Technical Paper 972838, 1997, pp. 239-250.

(Continued)

*Primary Examiner* — Cephia D Toomer
(74) *Attorney, Agent, or Firm* — Robert A. Migliorini

(57) ABSTRACT

Provided are octane enhancing additives and methods that improve a liquid fuel composition's octane rating. A liquid fuel composition may comprise a liquid fuel and an octane enhancing additive. The octane enhancing additive may comprise an indoline compound with a bicyclic ring structure, wherein the indoline compound comprises a six-membered aromatic ring and a five-membered aliphatic ring that share a carbon-carbon aromatic bond. The five-membered aliphatic ring may be heterocyclic and may comprise a nitrogen positioned in an alpha position to the six-membered aromatic ring.

16 Claims, 2 Drawing Sheets

Related U.S. Application Data

(60) Provisional application No. 62/776,496, filed on Dec. 7, 2018.

(58) Field of Classification Search
CPC ..... C10L 2200/043; C10L 2200/0438; C10L 2270/023; C10L 2270/026; C10L 2270/04
See application file for complete search history.

(56) References Cited

U.S. PATENT DOCUMENTS

| | | | | |
|---|---|---|---|---|
| 4,670,131 | A | 6/1987 | Ferrell | |
| 6,210,452 | B1 | 4/2001 | Su | |
| 6,323,175 | B1 | 11/2001 | Hsia | |
| 7,910,607 | B2 | 3/2011 | Ba et al. | |
| 8,540,871 | B2 | 9/2013 | Zhan et al. | |
| 10,808,194 | B2 * | 10/2020 | Abdallah | C10L 1/232 |
| 2003/0110684 | A1 | 6/2003 | Henly et al. | |
| 2005/0103686 | A1 | 5/2005 | Taylor | |
| 2007/0204505 | A1 | 9/2007 | Abou-Nemeh | |
| 2008/0028674 | A1 | 2/2008 | Jackson et al. | |
| 2009/0107555 | A1 * | 4/2009 | Aradi | C10L 1/238 137/13 |
| 2010/0319243 | A1 | 12/2010 | Aradi et al. | |
| 2012/0000117 | A1 | 1/2012 | Aradi | |
| 2012/0024751 | A1 | 2/2012 | He et al. | |
| 2017/0100617 | A1 | 4/2017 | Kochelek et al. | |
| 2018/0037838 | A1 * | 2/2018 | Orlebar | C10M 133/12 |
| 2018/0346837 | A1 * | 12/2018 | Abdul-Manan | C10L 10/10 |

OTHER PUBLICATIONS

T. Nishixzaki et al., The Effects of Fuel Composition and Fuel Additives on Intake System Detergency of Japanese Automobile Engine, SAE Technical Paper 790203, 1979, pp. 1-13.

The International Search Report and Written Opinion of PCT filing, PCT/US2019/062983, dated Feb. 2, 2020.

Schadlich, et al., "Octane Enhancers", Ullmann's Encyclopedia of Industrial Chemistry, Jan. 1, 2005, pp. 1-15, Wiley-VCH Verlag GmbH & Co.

PCT/US2021/026323 International Search Report and Written Opinion dated Jul. 21, 2021.

* cited by examiner

MOTOR GASOLINE WITH IMPROVED OCTANE AND METHOD OF USE

CROSS-REFERENCE TO RELATED APPLICATIONS

This application is a Continuation-in-Part Application and claims priority to pending U.S. application Ser. No. 16/694,044 filed on Nov. 25, 2019, the entirety of which is incorporated herein by reference, which claims the benefit of U.S. Provisional Application No. 62/776,496 filed Dec. 7, 2018, entitled "Fuel High Temperature Antioxidant Additive", the disclosure of which is also incorporated herein by reference.

FIELD

This application relates to octane enhancing additives for liquid fuels, and, more particularly, embodiments relate to octane enhancing additives including an indoline compound that improves a liquid fuel's octane rating.

BACKGROUND

Spark ignition engines can have improved operation when operated with a fuel that provides a sufficient octane rating so that the start of combustion is substantially controlled by the introduction of a spark into the combustion chamber. Fuels that do not have a sufficient octane rating can cause "knocking" in the engine, where at least part of the combustion in the engine is not dependent on the introduction of the spark into the combustion chamber.

Higher-octane gasoline is required to enable motor manufacturers to meet stringent vehicle $CO_2$ emissions targets via more fuel-efficient cars. It is of value to improve knock resistance through use of metal-free, organic, high-octane additive solutions at low concentrations such as less than 1 weight %. Organic octane enhancing additives or octane boosters have been investigated mainly as a replacement to organometallic octane boosters such as tetra-ethyl lead and methylcyclopentadienyl manganese tricarbonyl. The most common organic octane booster is ethanol; however, blend concentrations of significantly greater than 1 wt. % is required to achieve meaningful octane increase and oxygenates give a reduction in energy density in the fuel. Organic compounds based on aromatic nitrogen compounds can be effective at less than 1 wt. %. Relevant organic octane enhancing additives based on aromatic nitrogen compounds references include; Jerome E. Brown, Francis X. Markley, Hymin Shapiro, Mechanism of Aromatic Amine Antiknock Action, Industrial & Engineering Chemistry, 1955, 47, 10, p. 2141 and Robert MacKinven, Search for Ash-Free Compounds to Replace Lead Alkyls in Gasoline, Dtsch. Ges. fuer Mineraloelwiss and Kohlechem, 24th Symp. Compend. 74/75, Hamburg, September 30-October 3, 2 (1974) p. 687. The most effective currently available commercial additive is N-methyl aniline (NMA) (IOB 3000—Metal free octane enhancer from Innospec, Inc.) and toluidines that have been shown to increase octane in aviation gasoline (U.S. Pat. No. 5,470,358).

Traditionally, fuels for spark ignition engines have been characterized based on use of octane rating methods. A common method for characterizing the octane rating of a composition is to use the Research Octane Number (RON) and the Motor Octane Number (MON) or an average of the two called the Antiknock Index ((RON+MON)/2). Research Octane Number (RON) is determined according to ASTM D2699. Motor Octane Number (MON) is determined according to ASTM D2700. This type of octane rating can be used to determine the likelihood of "knocking" behavior when operating a conventional spark ignition engine.

Another method for characterization of a fuel composition is a constant volume combustion chamber (CVCC) apparatus such as the AFIDA (Advanced Fuel Ignition Delay Analyzer) available by ASG Analytik-Service GmbH. CVCCs measure the time interval between injection of the liquid fuel and combustion of the vaporized fuel which is referred to as the combustion ignition delay. Many CVCC apparatus are correlated to cetane number, the measure of the ignition properties of diesel fuel. Octane number is generally the inverse of cetane number, and thus higher octane fuels are associated with longer combustion ignition delay times on CVCC testing apparatuses. References to combustion ignition delay in the examples below refer to the time it takes to reach a maximum on the dP/dt curve.

There is a need for fuels with higher octane rating. Accordingly, there remains a need for additives for a spark-ignition internal combustion engine that are able to achieve anti-knock effects, e.g. at least comparable to the anti-knock effects to N-Methyl Analine (NMA).

SUMMARY

Disclosed herein is an example liquid fuel composition. The example liquid fuel composition may include a liquid fuel and an octane enhancing additive. The octane enhancing additive may include an indoline compound with a bicyclic ring structure, wherein the indoline compound includes a six-membered aromatic ring having two adjacent aromatic carbon atoms with a five membered unsubstituted saturated heterocyclic ring, the five membered saturated heterocyclic ring comprising a nitrogen atom directly bonded to one of the shared carbon atoms, alpha position to the six-membered aromatic ring, to form a secondary amine.

Further disclosed herein is another exemplary liquid fuel composition. The exemplary liquid fuel composition may include a liquid fuel in an amount of about 50 wt. % or greater and an octane enhancing additive. The octane enhancing additive may include an indoline compound having the following structure:

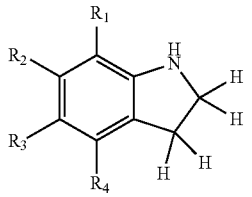

wherein $R_1$, $R_2$, $R_3$, and $R_4$ are individually selected from hydrogen, an alkyl group, an alkenyl group, a heteroatom substituted alkyl group, or a heteroatom substituted alkenyl group.

Further disclosed herein is a method for improving octane rating of a liquid fuel in an engine. An exemplary method may include combusting in an internal combustion engine a fuel composition including the liquid fuel and an octane enhancing additive. The octane enhancing additive may include an indoline compound with a bicyclic ring structure. The indoline compound may include a six-membered aromatic ring and a five-membered aliphatic ring that share a carbon-carbon aromatic bond. The five-membered aliphatic ring may be heterocyclic and includes a nitrogen positioned in an alpha position to the six-membered aromatic ring.

Still further disclosed is a liquid fuel composition comprising: a major amount of a liquid fuel; and a minor amount of an octane enhancing additive comprising an indoline compound with a bicyclic ring structure, wherein the indoline compound comprises a six-membered aromatic ring and a five-membered aliphatic ring that share a carbon-carbon aromatic bond, wherein the five-membered unsubstituted aliphatic ring is heterocyclic and comprises a nitrogen positioned in an alpha position to the six-membered aromatic ring.

Still further disclosed is a liquid fuel composition comprising: a liquid fuel in an amount of about 95 wt. % or greater; and from 0.1 wt. % to 5 wt. % of an octane enhancing additive comprising an indoline compound having the following structure:

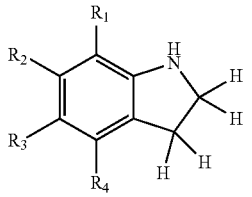

wherein $R_1$, $R_2$, $R_3$, and $R_4$ are individually selected from hydrogen, an alkyl group, an alkenyl group, a heteroatom substituted alkyl group, or a heteroatom substituted alkenyl group.

Still yet further disclosed is a method for improving the auto-ignition characteristics of a liquid fuel combusted at high compression ratios, comprising: blending a minor amount of an octane enhancing additive into a major amount of liquid fuel to form a liquid fuel composition wherein the octane enhancing additive comprises an indoline compound with a bicyclic ring structure, wherein the indoline compound comprises a six-membered aromatic ring and a five-membered aliphatic ring that share a carbon-carbon aromatic bond, wherein the five-membered aliphatic ring is heterocyclic and comprises a nitrogen positioned in an alpha position to the six-membered aromatic ring, and combusting in an internal combustion engine a fuel composition comprising the liquid fuel and an octane enhancing additive, wherein the octane enhancing additive comprises an indoline compound with a bicyclic ring structure, wherein the indoline compound comprises a six-membered aromatic ring and a five-membered aliphatic ring that share a carbon-carbon aromatic bond, wherein the five-membered aliphatic ring is heterocyclic and comprises a nitrogen positioned in an alpha position to the six-membered aromatic ring.

BRIEF DESCRIPTION OF THE DRAWINGS

These drawings illustrate certain aspects of the present invention and should not be used to limit or define the invention.

DETAILED DESCRIPTION

Definitions

Figure 1:
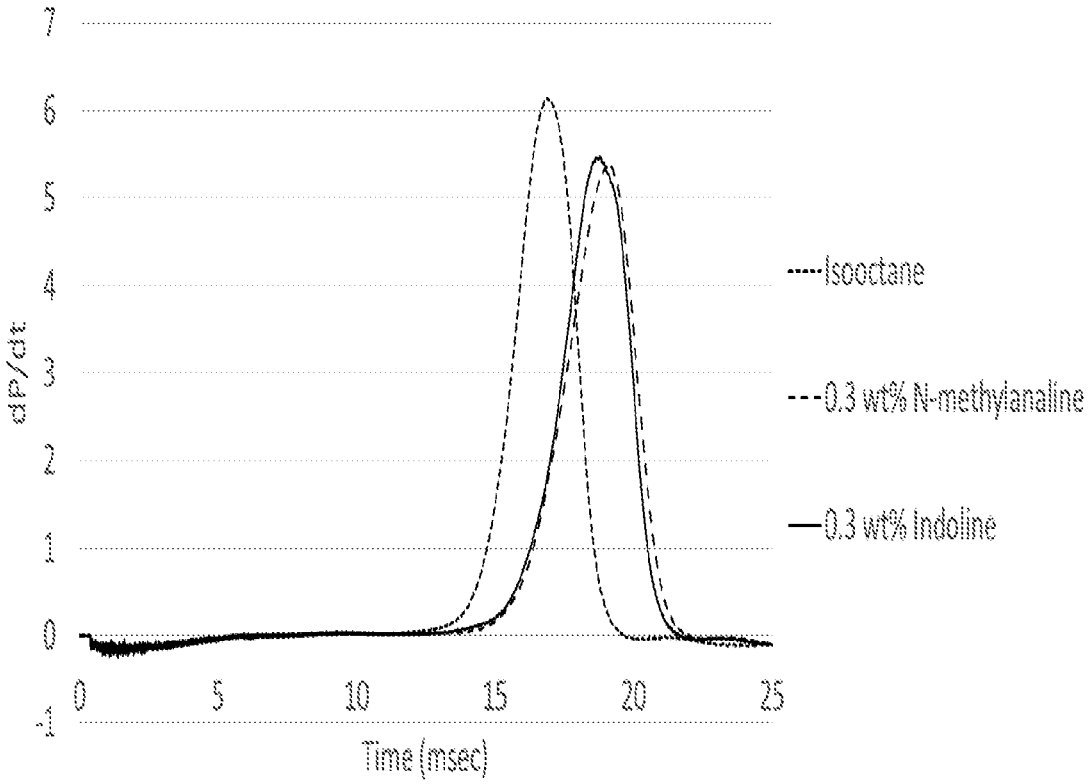
FIG. 1 shows a dP/dt curve from AFIDA testing apparatus for determining combustion ignition delay based on the heat release curves for isooctane and also isooctane with octane enhancing additives.

"About" or "approximately". All numerical values within the detailed description and the claims herein are modified by "about" or "approximately" the indicated value, and take into account experimental error and variations that would be expected by a person having ordinary skill in the art.

"Major amount" as it relates to components included within the liquid fuel compositions of the specification and the claims means greater than or equal to 50 wt. %, or greater than or equal to 60 wt. %, or greater than or equal to 70 wt. %, or greater than or equal to 80 wt. %, or greater than or equal to 90 wt. %, based on the total weight of the liquid fuel composition.

"Minor amount" as it relates to components included within the liquid fuel compositions of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the liquid fuel composition.

"Essentially free" as it relates to components included within the liquid fuel compositions of the specification and the claims means that the particular component is at 0 weight % within the liquid fuel composition, or alternatively is at impurity type levels within the liquid fuel composition (less than 100 ppm, or less than 20 ppm, or less than 10 ppm, or less than 1 ppm).

All percentages in describing liquid fuel compositions herein are by weight unless specified otherwise. "Wt. %" means percent by weight.

Liquid Fuel Compositions Disclosed Herein

The present application discloses a new nitrogen containing organic octane enhancing additive. Indoline has been found to increase octane rating as much as NMA in ethanol free gasoline (E0) and gasoline containing 10% ethanol (E10). Unlike NMA, indoline may also improve the thermal stability of the fuel which is especially important when using additives at the relatively high levels (more than ppm levels) necessary for organic octane enhancers.

This application relates to octane enhancing additives for liquid fuels, and, more particularly, embodiments relate to octane enhancing additives including an indoline compound and methods that improve a liquid fuel composition's octane rating. As used herein, the octane enhancing additives improve a liquid fuel composition's octane rating.

There may be several potential advantages to the compositions and methods disclosed herein, only some of which may be alluded to in the present disclosure. One of the many potential advantages of the compositions and methods is that the octane enhancing additive should extend the combustion ignition delay of the vaporized fuel composition. The combustion ignition delay is the time between liquid fuel injection and combustion of the fuel vapors in the combustion chamber. By extending the ignition delay, spark timing can be advanced to improve engine efficiency.

Suitable octane enhancing additives may include an indoline compound. Indoline compounds have a bicyclic ring structure and include a six-membered aromatic ring and a five-membered aliphatic ring sharing a carbon-carbon aromatic bond. The aliphatic ring is heterocyclic and includes nitrogen positioned alpha (i.e., adjacent) to the aromatic ring. The aromatic ring may be heterocyclic or carbocyclic. In some embodiments, the aromatic ring may be substituted. Exemplary substituents may include, but are not limited to, alkyl groups, alkenyl groups, heteroatom substituted alkyl groups, or heteroatom substituted alkenyl groups. Suitable heteroatoms that may be substituted may include, but are not limited to, nitrogen, oxygen, and sulfur, among others.

The discovery of octane enhancing properties of indoline are unexpected, especially in light of the data on 2-methylindoline disclosed in U.S. Patent Publication No. 20090107555A1. 2-methylindoline, which has a methyl substitution on the 5 member heterocyclic aliphatic ring in the 2 position has been reported to enhance the cetane rating, the inverse property of octane improver, and acts as an ignition promoter. Ignition promoters lower the octane rating. U.S. Patent Publication No. 20090107555A1 discloses a large lowering of both the RON and MON with the blending of 5000 mg/L of 2-methylindoline into fuel. 2-methylindoline additive may find application in diesel fuels for compression ignition combustion engines, which are typically diesel engines. Because of this property, 2-methylindoline would not be a suitable additive for use in a spark-ignition engine as it would lower the octane rating of the fuel.

Examples of suitable octane enhancing additives including an indoline compound may include, but are not limited to, a bicyclic ring structure of Formula (1) as follows:

(1)

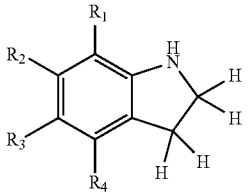

wherein $R_1$, $R_2$, $R_3$, and $R_4$ are individually selected from hydrogen, an alkyl group, an alkenyl group, a heteroatom substituted alkyl group, or a heteroatom substituted alkenyl group. Suitable heteroatoms that may be substituted may include, but are not limited to, nitrogen, oxygen, and sulfur, among others. The alkyl or alkenyl (or heteroatom substituted) groups of $R_1$, $R_2$, $R_3$, and $R_4$ may be the same or different and, in some embodiments, may include 1 carbon atom to 18 carbon atoms, or, more particularly, include 1 carbon atom to 2 carbon atoms. In some embodiments, $R_1$, $R_2$, $R_3$, and $R_4$ are each hydrogen.

Yet another example of a suitable octane enhancing additive including an indoline compound may include, but are not limited to, a bicyclic ring structure of Formula (2) as follows:

(2)

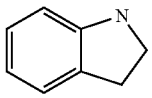

As previously described, the octane enhancing additive including an indoline compound can be used to improve a liquid fuel composition's octane rating. The octane enhancing additive may be included in the liquid fuel composition in any suitable amount as desired for improving octane rating. In some embodiments, the octane enhancing additive composition can be present in the liquid fuel composition in an amount ranging from about 0.01 wt. % to about 50 wt. % and, more particularly, ranging from about 0.1 wt. % to about 10 wt. %, or about 0.2 wt. % to about 9 wt. %, or about 0.3 wt. % to about 8 wt. %, or about 0.4 wt. % to about 7 wt. %, or about 0.5 wt. % to about 6 wt. %, or about 0.6 wt. % to about 5 wt. %, or about 0.7 wt. % to about 4 wt. %, or about 0.8 wt. % to about 3 wt. %, or about 1.0 wt. % to about 2 wt. %, or about 1.2 wt. % to about 1.8 wt. %, or about 1.4 wt. % to about 1.6 wt. %. The appropriate amount of the octane enhancing additive may be based on a number of factors, including, but not limited to, fuel system operating conditions, the particular aromatic carbocyclic ring and substituents thereon, and the liquid fuel's hydrocarbon components, among others.

In some embodiments, the octane enhancing additive including an indoline compound may be included in a liquid fuel composition to extend an octane rating of the liquid fuel composition, which should result in improved combustion. The octane rating may be extended as compared to the liquid fuel composition without the octane enhancing additive, for example, from about 0.5 to 10, or 0.7 to 8, or 0.9 to 6, or 1.0 to 8, or 1.2 to 6, or 1.4 to 4, or 1.6 to 3, or 1.8 to 2.5, or 2.0 to 2.4 octane ratings than the fuel without the additive. As used herein, the octane enhancing is determined using the RON and MON rating tests methods.

In some embodiments, the octane enhancing additive including an indoline compound may be included in a liquid fuel composition to extend the ignition delay of the liquid fuel composition, which should result in improved turbine combustion. The ignition delay may be extended as compared to the liquid fuel composition without the octane enhancing additive. Delaying the ignition of the fuel allows an increase premixing of the fuel sprayed into a combustion chamber with the compressed air in a turbine engine. Increase premixing lowers emissions and avoids fuel ignition in close proximity of the nozzle that can cause nozzle coking.

In some embodiments, the octane enhancing additive may be introduced into a fuel system of an internal combustion engine. In some embodiments, the octane enhancing combination may be combined with the liquid fuel composition in the internal combustion engine. In some embodiments, the octane enhancing composition may be introduced into the internal combustion engine as a component of the liquid fuel composition. In a combustion chamber of the internal combustion engine, the liquid fuel composition may be burned. Suitable internal combustion engines may include, but are not limited to, rotary, turbine, spark ignition, 2-stroke, or 4-stroke engines. In some embodiments, the internal combustion engines include, aviation piston and turbine engines, aviation supersonic turbine engines, and automobile and truck engines. In some embodiments, the internal combustion engine may comprise a direct injection engine.

In addition to the octane enhancing additive, the liquid fuel composition may further include a liquid fuel. The liquid fuel may include, but are not limited to, motor gasoline, aviation gasoline, aviation turbine fuel, and supersonic fuel. Combinations of different liquid fuels may also be used. Motor gasoline includes a complex mixture of relatively volatile hydrocarbons blended to form a fuel suitable for use in spark-ignition engines. Motor gasoline, as defined in ASTM Specification D4814, is characterized as having a boiling range of 50° C. to 70° C. at the 10-percent recovery point to 185° C. to 190° C. at the 90-percent recovery point. The aviation turbine fuels can be a petroleum distillate as defined by ASTM specification D1655. The aviation gasoline can be mixture of various isooctanes, isoalkanes and aromatics compounds as defined by ASTM specification D910. The supersonic fuel can be a compound mixture composed primarily of hydrocarbons; including alkanes, cycloalkanes, alkylbenzenes, indanes/tetralins, and naphthalenes. As used herein, a supersonic fuel is a fuel that meets the specification for propellant, rocket grade kerosene (either RP-1 or RP-2) in MIL-DTL-25576, dated Apr. 14, 2006. Supersonic fuels are typically capable of standing up to higher heats (without undesirable breakdown) from air friction on the aircraft at speeds greater than the speed of sound. Fuel that breaks down can cause deposits that potentially restrict fuel flow in fuel lines. Additional examples of suitable liquid fuels may include, but are not limited to, an alcohol, an ether, or combinations thereof. In some embodiments, the alternative fuels may include, but are not limited to, methanol, ethanol, diethyl ether, and methyl t-butyl ether. In some embodiments, the liquid fuel may include a mixture of a motor gasoline and ethanol.

The liquid fuel may be present in the liquid fuel composition with the octane enhancing additive in any suitable amount. As previously described, the liquid fuel may include any suitable liquid fuel, including a combination of two or more different fuels. In some embodiments, the liquid fuel may be present in the liquid fuel composition in an amount ranging from about 0.01 wt. % to about 99.9 wt. %, or from 0.05 wt. % to about 99.5 wt. %, or from 0.1 wt. % to about 99 wt. %, or from 0.5 wt. % to about 98 wt. %, or from 1 wt. % to about 97 wt. %, or from 3 wt. % to about 95 wt. %, or from 5 wt. % to about 90 wt. %, or from 10 wt. % to about 85 wt. %, or from 15 wt. % to about 80 wt. %, or from 20 wt. % to about 70 wt. %, or from 30 wt. % to about 60 wt. %, or from 40 wt. % to about 50 wt. %. One of ordinary skill in the art, with the benefit of this disclosure, should be able to select an appropriate liquid fuel and amount thereof to include in the liquid fuel composition for a particular application.

In some embodiments, additional additives can be included in the liquid fuel composition as desired by one of ordinary skill in the art for a particular application. Examples of these additional additives include, but are not limited to, detergents, rust inhibitors, corrosion inhibitors, lubricants, antifoaming agents, demulsifiers, conductivity improvers, metal deactivators, cold-flow improvers, cetane improvers and fluidizers, among others. One of ordinary skill in the art, with the benefit of this disclosure, should be able to select additional additives and amounts thereof as needed for a particular application.

EXAMPLES

To facilitate a better understanding of the present invention, the following examples of certain aspects of some embodiments are given. In no way should the following examples be read to limit, or define, the entire scope of the invention.

Example 1

The effect of octane-boosting indoline on the octane number of two different base fuels for a spark-ignition internal combustion engine was measured. The additive was added to the fuels at a relatively low treat rate of 0.6 wt. % (weight additive/weight base fuel). The first fuel was a base gasoline with 0 vol. % ethanol (E0). The second fuel was a base gasoline containing 10 vol. % ethanol (E10). The RON and MON of the base fuels, as well as the blends of base fuel and octane enhancing additive, were determined according to ASTM D2699 and ASTM D2700, respectively. The octane enhancing additive was an indoline compound of Formula 2 above. For comparative purposes, the octane rating for the same motor gasoline was also tested with NMA, a commercial octane enhancing additive.

The following Table 1 shows the RON and MON of the fuel and the blends of fuel and octane enhancing additive, as well as the change in the RON and MON that was brought about by using the octane enhancing additives:

TABLE 1

Octane rating results of base fuels with and without 0.6 wt % octane enhancing additives

| | E0 base fuel | | | | E10 base fuel | | | |
|---|---|---|---|---|---|---|---|---|
| Additive | RON | MON | ΔRON | ΔMON | RON | MON | ΔRON | ΔMON |
| — | 88.6 | 81.3 | NA | NA | 93.3 | 84.1 | NA | NA |
| Indoline | 90.4 | 82.2 | 1.8 | 0.9 | 94.8 | 84.6 | 1.5 | 0.5 |
| NMA | 90.2 | 82.5 | 1.6 | 1.2 | 96.5 | 85.7 | 3.2 | 1.6 |

It can be seen from Table 1 that the indoline increased the RON and MON of an ethanol-free and an ethanol-containing fuel for a spark-ignition internal combustion engine.

Example 2

To further illustrate the difference, additional supporting tests were conducted using a constant volume combustion chamber. This testing also shows that indoline increases the combustion ignition delay in isooctane. An octane enhancing additive was added to isooctane in an amount of 0.3 wt %. The octane enhancing additive was an indoline compound of Formula 2 above. The ignition delay was then measured for isooctane and isooctane with 0.3 wt % indoline using an AFIDA 2805—Advanced Fuel Ignition Delay Analyzer. AFIDA conditions are highlighted in the Table 2 below. For comparative purposes, the ignition delay for isooctane with a commercially available octane enhancer NMA was also tested.

TABLE 2

AFIDA parameters

| | |
|---|---|
| Chamber wall temp | 620° C. |
| Chamber pressure | 25 bar |
| Injection time | 5000 msec |
| Injection pressure | 300 bar |
| Injector temp | 113° C. |

FIG. 1 shows the dP/dt trace used for determining the combustion ignition delay for these tests. As illustrated, the addition of 0.3 wt % of the octane enhancing additive extended the combustion ignition delay for isooctane by 1.9 msec. A comparative commercially available octane enhancer additive, NMA, shows a similar combustion ignition delay of 2.0 msec in isooctane.

Example 3

To further illustrate the difference, additional constant volume combustion chamber tests were performed on indoline additives with substitutions on the 6 member aromatic ring. The octane enhancing additives were an indoline compound of Formula 1 above and include 7-methylindoline (R1=methyl, R2, R3, R4=H), 5-methylindoline (R3=methyl, R1, R2, R4=H), and 5-methoxyindoline (R3=methoxy, R1, R2, R4=H). An octane enhancing additive was added to isooctane in an amount of 0.3 wt %. The ignition delay was then measured for isooctane and isooctane with 0.3 wt % additive using an AFIDA 2805—Advanced Fuel Ignition Delay Analyzer. AFIDA conditions are highlighted in the Table 2 above.

Figure 2:
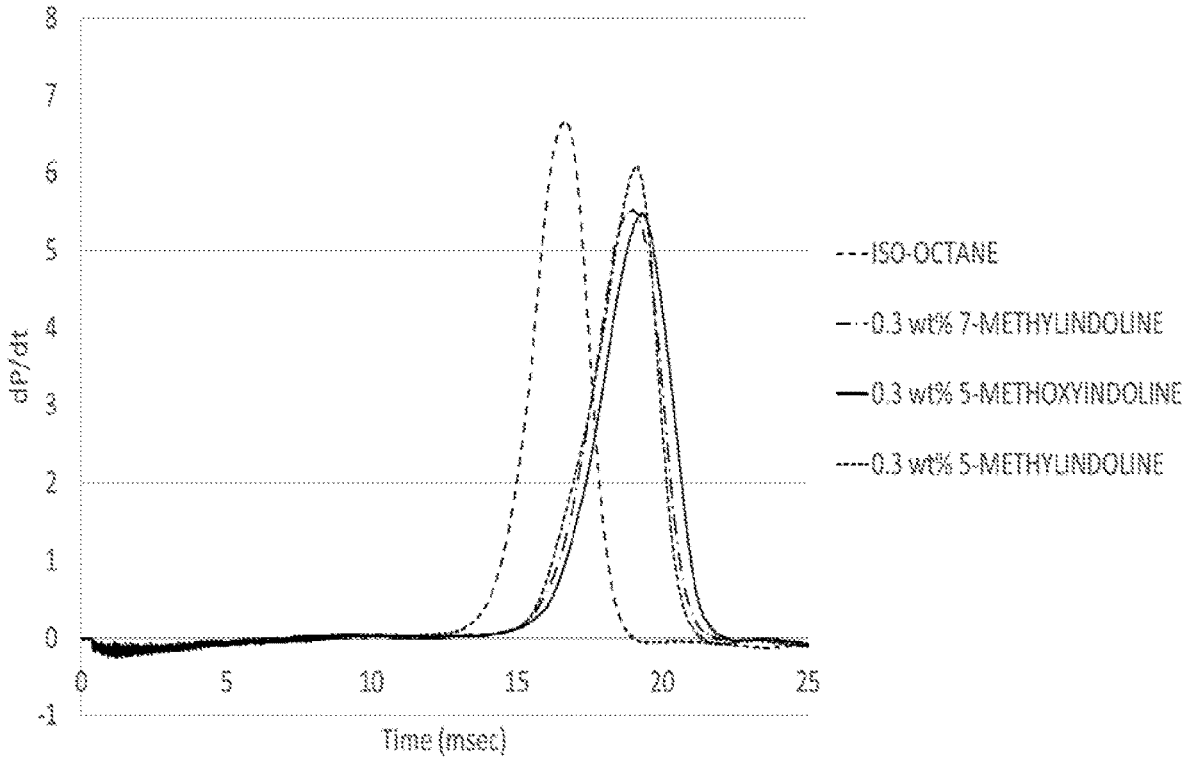
FIG. 2 shows a dP/dt curve from AFIDA testing apparatus for determining combustion ignition delay based on the heat release curves for isooctane and also isooctane with octane enhancing additives 7-methylindoline, 5-methylindoline, and 5-methoxyindoline.

FIG. 2 shows the dP/dt trace used for determining the combustion ignition delay for these tests. As illustrated, the addition of 0.3 wt % of substituted indoline octane enhancing additives extended the combustion ignition delay by 2.4 msec for 7-methylindoline (R1=methyl, R2, R3, R4=H), 2.6 msec for 5-methylindoline (R3=methyl, R1, R2, R4=H), and 2.7 msec for 5-methoxyindoline (R3=methoxy, R1, R2, R4=H). All substituted indolines tested performed better than the unsubstituted indoline at the same weight percent.

While the invention has been described with respect to a number of embodiments and examples, those skilled in the art, having benefit of this disclosure, will appreciate that other embodiments can be devised which do not depart from the scope and spirit of the invention as disclosed herein. Although individual embodiments are discussed, the invention covers all combinations of all those embodiments.

While compositions, methods, and processes are described herein in terms of "comprising," "containing," "having," or "including" various components or steps, the compositions and methods can also "consist essentially of" or "consist of" the various components and steps. The phrases, unless otherwise specified, "consists essentially of" and "consisting essentially of" do not exclude the presence of other steps, elements, or materials, whether or not, specifically mentioned in this specification, so long as such steps, elements, or materials, do not affect the basic and novel characteristics of the invention, additionally, they do not exclude impurities and variances normally associated with the elements and materials used.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited.

The invention claimed is:

1. A liquid fuel composition comprising:

a major amount of a liquid fuel; and a minor amount of an octane enhancing additive comprising an indoline compound;

wherein the indoline compound has the following structure:

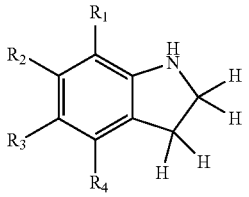

wherein $R_1$, $R_2$, $R_3$, and $R_4$ are individually selected from hydrogen, an alkyl group, an alkenyl group, a heteroatom substituted alkyl group, or a heteroatom substituted alkenyl group;

wherein the octane enhancing additive six-membered aromatic ring is substituted with at least one substituent selected from the group consisting of an alkyl group, an alkenyl group, a heteroatom substituted alkyl group, and a heteroatom substituted alkenyl group;

wherein the liquid fuel comprises a mixture of a motor gasoline or an aviation gasoline and an oxygenate selected from the group consisting of an alcohol, an ether and a combination thereof; and wherein the liquid fuel composition extends the octane rating of the composition compared to the liquid fuel composition without the octane enhancing additive from about 0.5 to 10.

2. The liquid fuel composition of claim 1, wherein the liquid fuel comprises a mixture of a motor gasoline and ethanol.

3. The liquid fuel composition of claim 1, wherein the liquid fuel is present in an amount of about 90 wt. % or greater.

4. The liquid fuel composition of claim 1, wherein the octane enhancing additive six-membered aromatic ring is substituted with at least one substituent selected from the group consisting of an alkyl group, an alkenyl group, a heteroatom substituted alkyl group, and a heteroatom substituted alkenyl group.

5. The liquid fuel composition of claim 1, wherein at least one of $R_1$, $R_2$, $R_3$, and $R_4$ are hydrogen.

6. The liquid fuel composition of claim 1, wherein at least one of at least one of $R_1$, $R_2$, $R_3$, and $R_4$ comprises an alkyl or alkenyl group having a length of 1 carbon atom to 18 carbon atoms.

7. The liquid fuel composition of claim 1, wherein the indoline compound has the following structure:

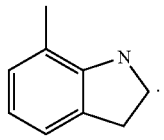

8. The liquid fuel composition of claim 1, wherein the indoline compound has the following structure:

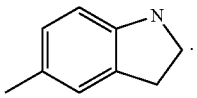

9. The liquid fuel composition of claim 1, wherein the indoline compound has the following structure:

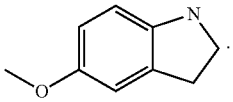

10. The liquid fuel composition of claim 1, wherein the octane enhancing additive is present in an amount ranging from about 0.1 wt. % to about 10 wt. %.

11. The liquid fuel composition of claim 1, further comprising at least one additional additive selected from the group consisting of a detergent, a rust inhibitor, a corrosion inhibitor, a lubricant, an antifoaming agent, a demulsifier, a conductivity improver, a metal deactivator, a cold-flow improver, a cetane improver, fluidizer, and combinations thereof.

12. The liquid fuel composition of claim 1, wherein the liquid fuel comprises a naphtha boiling range liquid fuel in an amount of about 95 wt. % or greater, wherein the octane enhancing additive is present at from 0.1 wt. % to 5 wt. %, and wherein the liquid fuel composition has a research octane number (RON) of about 80 to about 110.

13. A liquid fuel composition comprising:

a liquid fuel in an amount of about 95 wt. % or greater; and from 0.1 wt. % to 5 wt. % of an octane enhancing additive comprising an indoline compound having the following structure:

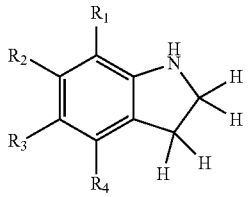

wherein $R_1$, $R_2$, $R_3$, and $R_4$ are individually selected from hydrogen, an alkyl group, an alkenyl group, a heteroatom substituted alkyl group, or a heteroatom substituted alkenyl group;

wherein the octane enhancing additive six-membered aromatic ring is substituted with at least one substituent selected from the group consisting of an alkyl group, an alkenyl group, a heteroatom substituted alkyl group, and a heteroatom substituted alkenyl group;

wherein the liquid fuel comprises a mixture of a motor gasoline or an aviation gasoline and an oxygenate selected from the group consisting of an alcohol, an ether and a combination thereof; and wherein the liquid fuel composition extends the octane rating of the composition compared to the liquid fuel composition without the octane enhancing additive from about 0.5 to 10.

14. A method for improving the auto-ignition characteristics of a liquid fuel combusted at high compression ratios, comprising:

blending a minor amount of an octane enhancing additive into a major amount of liquid fuel to form a liquid fuel composition wherein the octane enhancing additive comprises an indoline compound, wherein the indoline compound has the following structure:

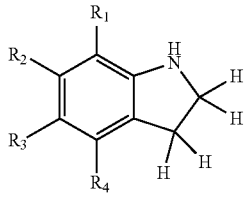

wherein $R_1$, $R_2$, $R_3$, and $R_4$ are individually selected from hydrogen, an alkyl group, an alkenyl group, a heteroatom substituted alkyl group, or a heteroatom substituted alkenyl group;

wherein the octane enhancing additive six-membered aromatic ring is substituted with at least one substituent selected from the group consisting of an alkyl group, an alkenyl group, a heteroatom substituted alkyl group, and a heteroatom substituted alkenyl group;

and combusting in an internal combustion engine a fuel composition comprising the liquid fuel and an octane enhancing additive, wherein the octane enhancing additive comprises an indoline compound with a bicyclic ring structure, wherein the liquid fuel comprises a mixture of a motor gasoline or an aviation gasoline and an oxygenate selected from the group consisting of an alcohol, an ether and a combination thereof; and wherein the liquid fuel composition extends the octane rating of the composition compared to the liquid fuel composition without the octane enhancing additive from about 0.5 to 10.

15. The method of claim 14, wherein the internal combustion engine is a direct injection engine.

16. The method of claim 14, wherein the internal combustion engine is a supersonic turbine engine.

* * * * *